United States Patent [19]

Reynolds

[11] 4,019,424

[45] Apr. 26, 1977

[54] CARTRIDGE SOFT FEED MECHANISM WITH MAGAZINE INTERRUPTER

[75] Inventor: George L. Reynolds, Cambridge, Ill.

[73] Assignee: The United States of America as represented by the Secretary of the Army, Washington, D.C.

[22] Filed: Apr. 12, 1976

[21] Appl. No.: 675,852

[52] U.S. Cl. ..... 89/137; 42/1 F; 42/11

[51] Int. Cl.[2] ..... F41D 11/14

[58] Field of Search ..... 42/1 F, 10, 11, 17; 89/33 B, 137, 161

[56] References Cited

UNITED STATES PATENTS

| | | | |
|---|---|---|---|
| 877,657 | 1/1908 | Mason | 89/161 |
| 1,360,188 | 11/1920 | Croy | 42/11 |

*Primary Examiner*—Stephen C. Bentley

*Attorney, Agent, or Firm*—Nathan Edelberg; Harold H. Card, Jr.; Robert O. Richardson

[57] ABSTRACT

A cartridge soft feed mechanism for presenting the cartridge to the chamber of a gun in such a way that the axis of the cartridge experiences no lateral or angular movement during chambering. The cartridge is telescoped into the chamber without ramping, reducing the probability of damage to the cartridge and reducing the chance of chambering stoppage. The feed mechanism is inactivated by a chambered round sensor for refilling the magazine or removing and replacing a chambered round in order to permit barrel movement between its forward extended position and its rearward ready position. While the current weapon (30mm Multishot Grenade Launcher) utilizes a fixed breech and movable barrel, the mechanism is adaptable to movable breech fixed barrel weapons.

8 Claims, 11 Drawing Figures

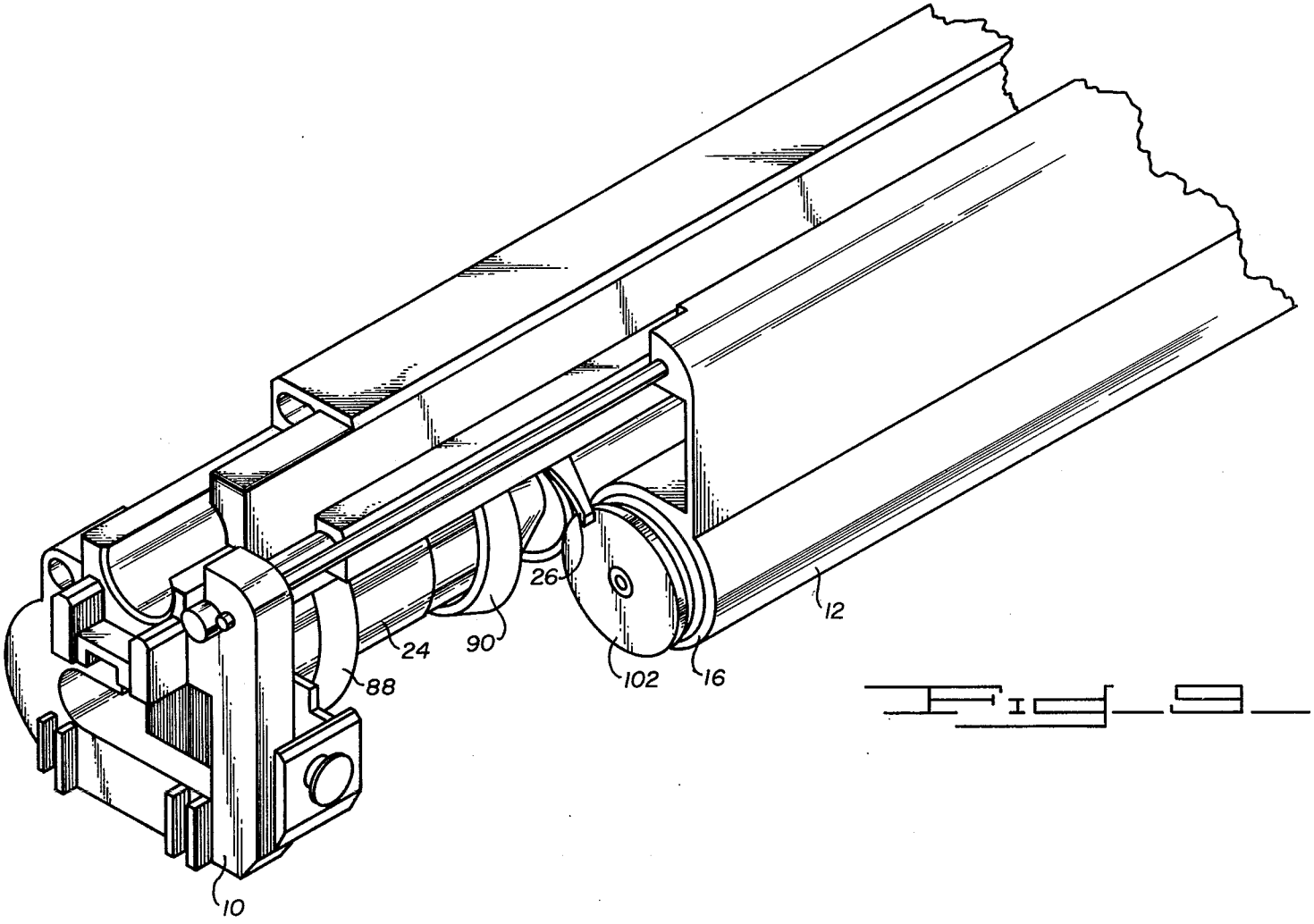
12
16
102
26
90
24
88
10

CARTRIDGE SOFT FEED MECHANISM WITH MAGAZINE INTERRUPTER

GOVERNMENTAL RIGHTS

The invention described herein may be manufactured and/or used by or for the Government for governmental purposes without the payment of any royalty thereon.

BACKGROUND OF THE INVENTION

Grenade launchers fire all kinds of grenades. Some are chemical, dispensing tear gas or nausea gas. Others eject flares for signaling, marking rounds with smoke, phosphorus for lighting fires, and regular high explosive grenades for anti-personnel purposes.

In combat situations, needs vary and there may be a need to hand-insert a special round in a multishot grenade launcher. To do this the feed mechanism must be inactivated, the chambered round removed, and the special round inserted. Also, in refilling the magazine, the feed mechanism feeds a second cartridge into chambering position behind the barrel when a round is already chambered. Since the barrel already contains a chambered round, the second cartridge in chambering position prevents the barrel from moving backward to the ready position, creating a malfunction. Also, if the cartridge case of a spent round fails to eject and stays in the barrel, it must be manually removed before a new cartridge can be chambered.

SUMMARY OF THE PRESENT INVENTION

A particular military weapon known as a modified XM-19 combines the functions of an infantry rifle and a grenade launcher. In order to accommodate a desired center of gravity on the weapon, the grenade launcher portion has a fixed breech and a movable barrel. When the grenade cartridge fires, expansive gases drive the barrel forward. This, in turn, moves the chamber forward so the empty cartridge case may be ejected. A return spring moves the barrel rearwardly over a newly chambered cartridge that was moved into position as the barrel was returned from its forward movement upon firing.

The feed mechanism for moving a cartridge to the breech block moves the cartridge laterally with its axis parallel to the gun barrel during this movement. This is done with feed lifters that are pivotally mounted and moved by a feed lever when a cartridge is not already in chambered position. A chambered cartridge sensor inactivates the feed mechanism when a cartridge is already in chambered position. This sensor on the barrel is held by a chambered cartridge from engaging the feed lever to move the feed lifters. Without a chambered cartridge, the sensor engages the feed lever upon barrel retraction to activate the cartridge feed mechanism.

BRIEF DESCRIPTION OF THE DRAWINGS

FIGS. 5, 6, 7 and 8 are schematic illustrations, taken along line 5—5 in FIG. 1, showing the feed mechanism in its several positions during operation, FIG. 9 is a perspective view of the feed mechanism with cartridges in the magazine and in chambered position, FIG. 10 is a side elevation view of the receiver showing the sensor when the cartridge has been ejected, and FIG. 11 is a side elevation view showing the sensor inactivating the feed mechanism bacause of a cartridge remaining in the chamber.

DETAILED DESCRIPTION OF ILLUSTRATIVE EMBODIMENT

Figure 1:
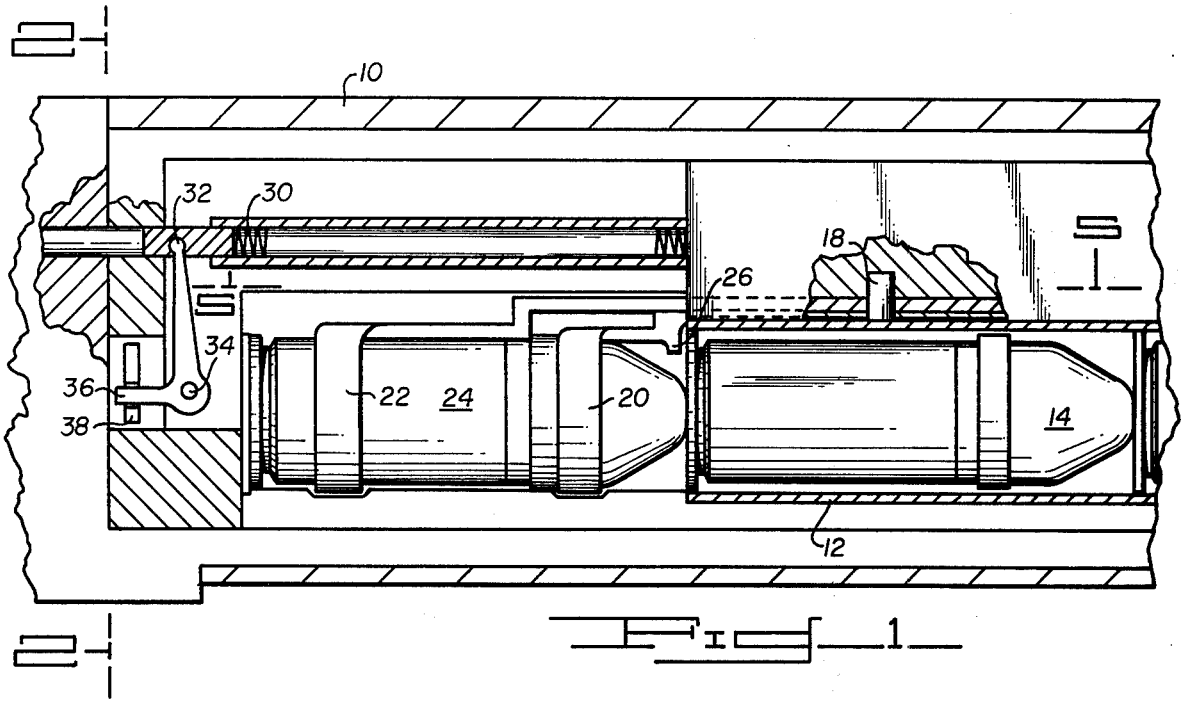
FIG. 1 is a side elevational view with parts broken away to show the feed mechanism.

Referring now to FIG. 1 there is shown a receiver 10 housing a magazine 12 containing a plurality of cartridges 14. This housing is tubular and has an open rear end 16 through which the cartridges pass in loading. The cartridges are placed in end to end relationship, nose forward, and are spring urged rearwardly.

Mounted on receiver 10 by means of a pivot pin 18 is a short feed lifter 20 and a long feed lifter 22 which work together in moving a cartridge 24 contained thereby laterally to its chambered position. Short feed lifter 20 has a stop member 26 which bears against the rearmost cartridge 14 in magazine 12 during this lateral movement. This prevents rearward movement of the rearmost cartridge until the lifters have been returned to their position to receive it. This operation will become more clear and understandable when further description is made hereinafter.

In order to operate this weapon in the grenade launcher mode, in accordance with the present invention, a selector switch not shown is set, moving pushrod 28 forward against return spring 30. A trigger lever 32 is pivotally mounted at pin 34 to receiver 10 and rotates clockwise in FIG. 1 when the pushrod 28 is moved forward. Trigger lever 32 has an arm 36 which engages a primary sear 38 and moves it upwardly when the trigger lever rotates. This disengages the firing pin operation, as can be seen in FIGS. 2 and 3.

Figure 2:
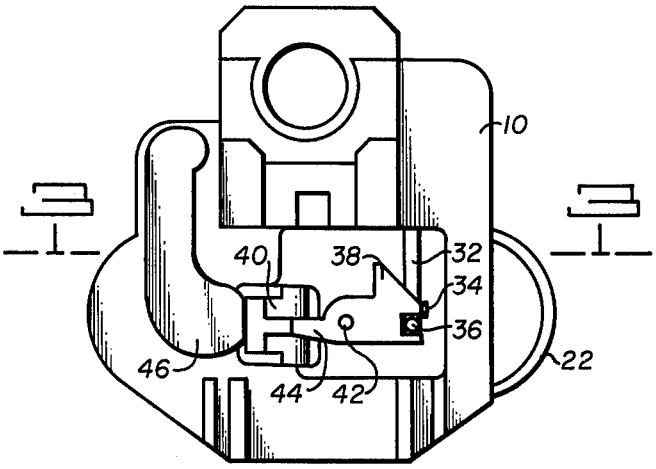
FIG. 2 is an end view taken along the line 2—2 in FIG. 1, showing the firing mechanism.
Figure 3:
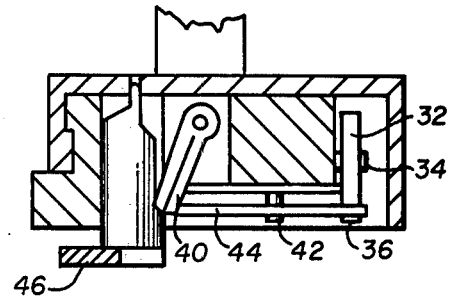
FIG. 3 is a plan view in section, taken along the line 3—3 in FIG. 2, showing the firing pin safety mechanism.

As can be seen in FIGS. 2 and 3, primary sear 38 is pivotally mounted at pin 42 on receiver 10 at substantially right angles to the trigger lever 32. Primary sear 38 has a stop member 44 engageable with firing pin stop 40 which, in turn, is engageable with firing pin 46 to prevent its forward movement. As shown in FIG. 3, firing pin stop 40 is pivotally mounted at pin 48 to receiver 10. When stop member 44 engages firing pin stop 40, it bears against and prevents firing pin 46 from firing. When the pushrod 28 in FIG. 1 is pushed forward to rotate trigger lever 32, primary sear 38 is rotated, freeing stop member 44 from engaging firing pin stop 40. This permits the non-rotating end of firing pin stop 40 to be pushed aside by the spring biased firing pin 46, and the weapon is now operable as a grenade launcher.

The grenade launcher mode of operation is only one of several modes of which this experimental rifle is capable. Others are automatic, semi-automatic and a three-shot burst mode. Because of structure for performing these modes, there is a requirement that the grenade launcher structure maintain the center of balance of the weapon over the trigger. To accomplish this, in accordance with the present invention, the breech remains fixed and the launcher barrel moves in response to the cartridge gases upon firing. The barrel moves forward against a compression spring which drives it back to recycle the launcher for the next shot.

Figure 4:
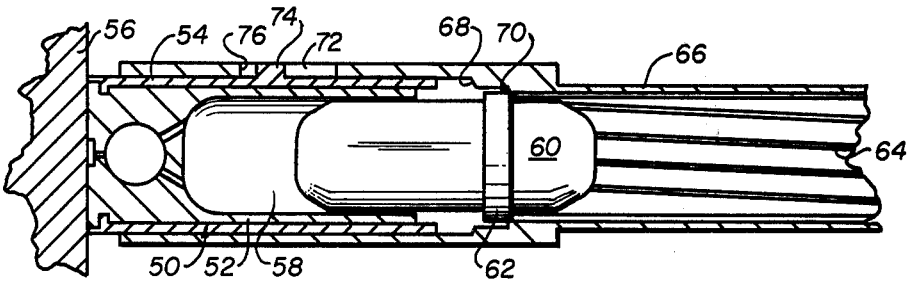
FIG. 4 is a plan view in section illustrating the fixed chamber, movable barrel mode of operation.

FIG. 4 illustrates the principle of operation of a fixed breech-movable barrel grenade launcher. Here is shown a cartridge 50 having its casing 52 within chamber 54 and forward of breech 56. In the position shown the propellent 58 has ignited and the grenade 60 has moved forwardly so that its bands 62 engage bands 64 in movable barrel 66. This initiates a forward movement of barrel 66, such movement being accelerated as grenade 60 moves forward and propellant gasses on shoulders 68, 70 of barrel 66 assist in the forward movement.

Barrel 66 has a slot 72 in which is carried a projection 74 on chamber 54. When this projection 74 engages the rear end 76 of slot 72, chamber 54 is then carried forward so that the spent casing 52 may be ejected. A compression spring, not shown, drives the barrel rearwardly and initiates the reloading cycle.

Figure 5:
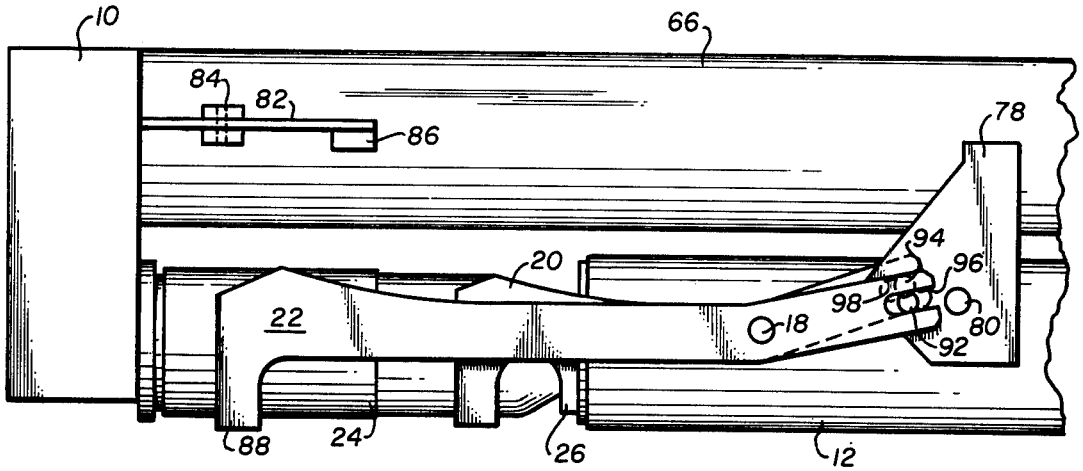
Figure 6:
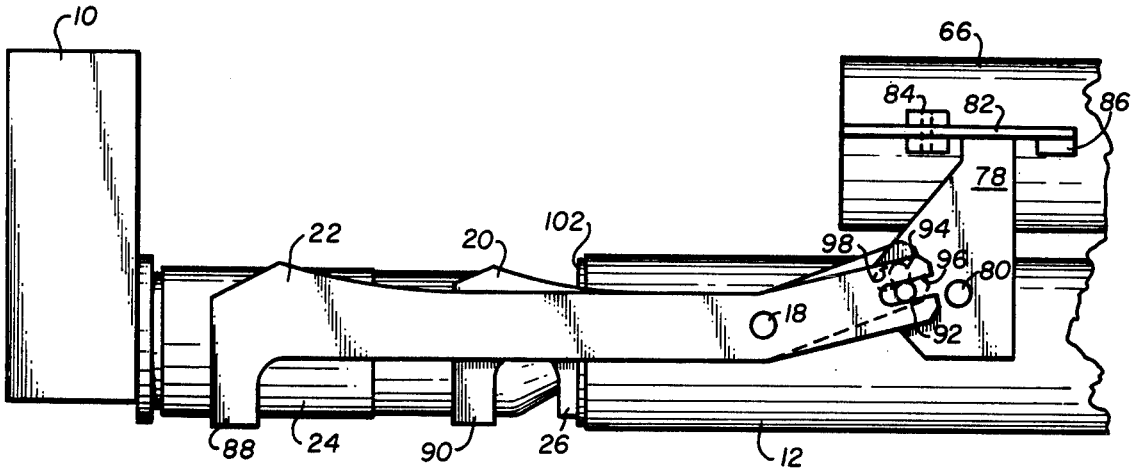
Figure 7:
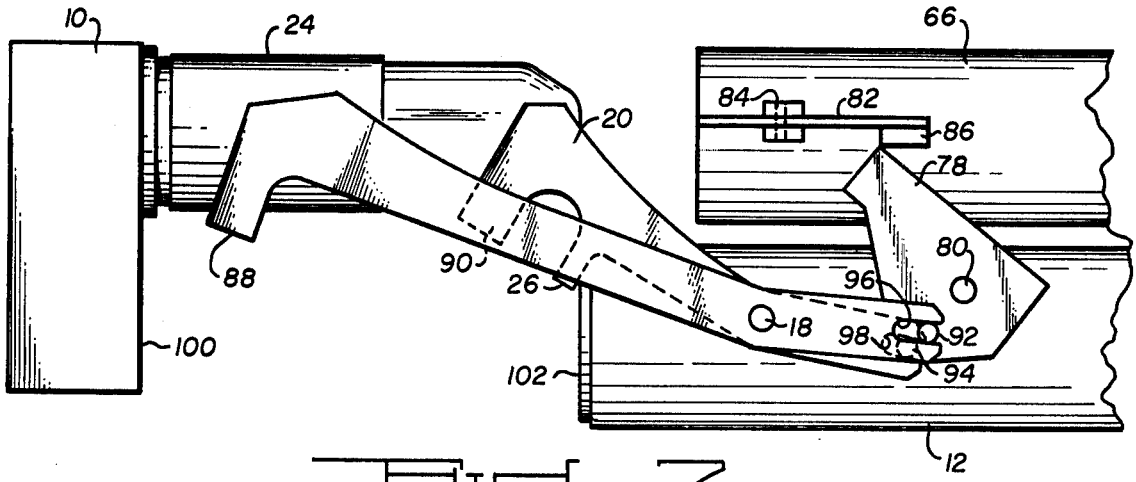
Figure 1:
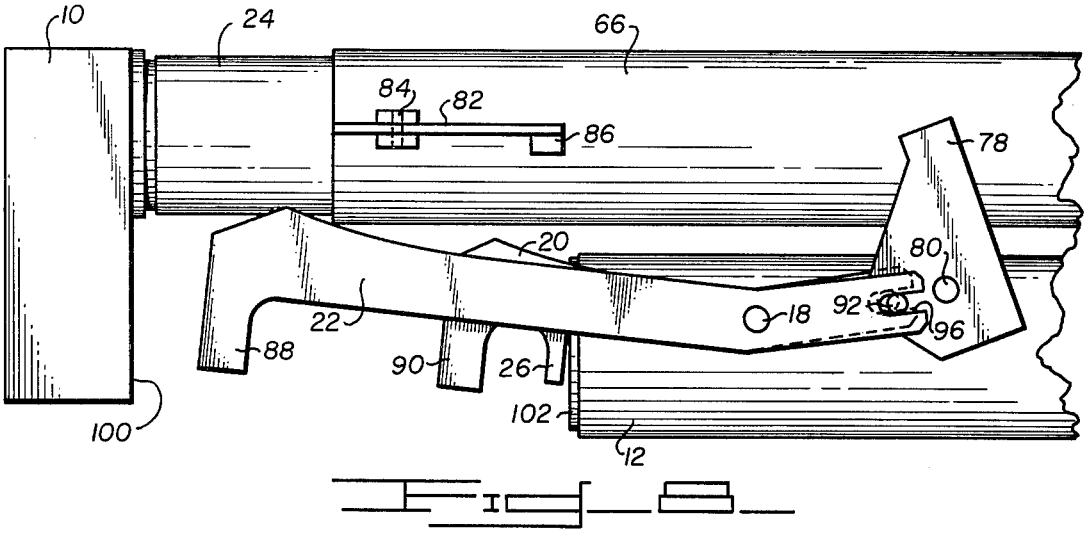
Figure 1:
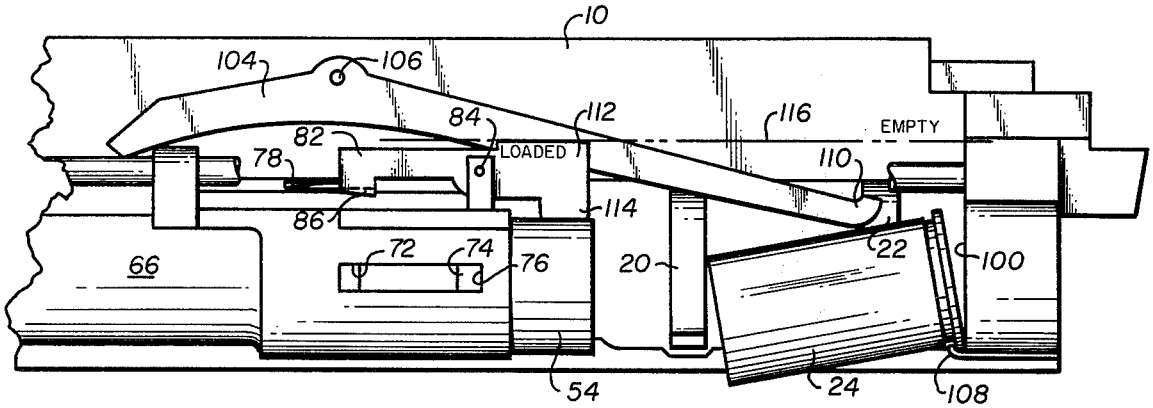
Figure 1:
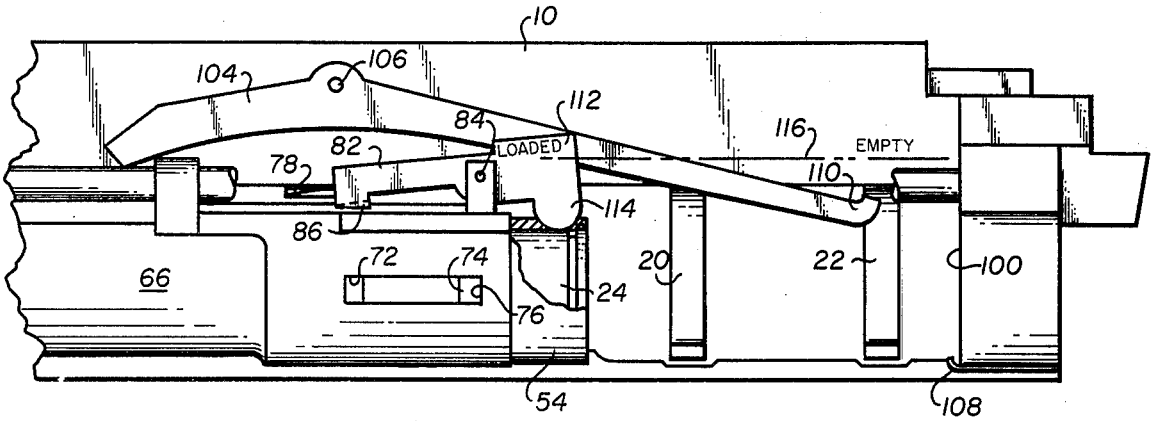

Reference is now made to FIGS. 5, 6, 7 and 8 which illustrate the several positions of the feed mechanism during operation. Here is shown magazine 12 in plan view to be horizontally disposed from barrel 66. A feed lever 78 is pivotally mounted at 80 to the receiver 10. A feed actuator 82 is pivotally mounted at 84 to barrel 66. The feed actuator 82 has a wedge shaped contact 86 which rides over the feed lever 78 as barrel 66 moves forward, as shown in FIGS. 5 and 6, but which engages and causes the feed lever 78 to rotate counterclockwise, as shown in FIG. 7, when barrel 66 is recycled rearwardly again. It is this action that moves the grenade cartridge 24 from rearwardly of magazine 12 to its fixed chamber position behind the rearwardly moving barrel 66.

The counterclockwise rotation of feed lever 78, as barrel 66 moves rearwardly, actuates feed lifters 20 and 22 and moves cartridge 24 laterally from its position in FIG. 6 to its position in FIGS. 7 and 9. Thus, when the barrel 66 returns to its firing position in FIG. 8, the cartridge is then chambered. Lifters 20 and 22 are pivotally mounted by pivot pin 18 on receiver 10 and, although feed lifter 20 is shorter than feed lifter 22, the cartridge engaging fingers 88, 90 of both lifters move laterally the same amount. In this manner the axis of cartridge 24 does not tilt during cartridge movement. It always remains parallel with the axis of the barrel.

The equal translational movement of lifter fingers 88, 90 when their lengths from pivot pin 18 are unequal is the result of dual actuating pins 92, 94 on opposed faces of feed lever 78. It should be noticed that long pin 92, which actuates the long feed lifter 22, is mounted on feed lever 78 a shorter distance from feed lever pivot pin 80 than is short pin 94, which actuates the short feed lifter 20. Upon inspection of FIGS. 5, 6 and 7 it can be seen that as feed lever 78 rotates, short pin 94 travels through a greater arc than long pin 92. This causes finger 90 on short feed lifter 20 to swing through a greater arc on a smaller radius than that of finger 88 on the long feed lifter 22. This is what keeps the fingers, and hence cartridge 24, in axial alignment parallel to the axis of barrel 66 during the sideways translational movement.

Although obvious upon inspection of the drawings, it should be noted that pins 92 and 94 engage slots 96, 98 in lifters 22, 20 respectively and cause their pivotal rotation as feed lifter 78 rotates.

FIGS. 5 and 9 illustrate the solution to one more problem, how to keep cartridges stored in magazine 12 while the feed lifters 20 and 22 are moving a cartridge into chamber position. These cartridges are continuously urged rearwardly in the magazine. If another cartridge moved rearwardly as cartridge 24 is moved to chamber position by the lifters, that cartridge would prevent the return of the lifters to their position in FIG. 5. Stop member 26 has been added to the short feed lifter 20 to prevent such a malfunction. This stop member has a forward edge that is a cartridge length away from the breech block 100 of receiver 10. As shown in FIG. 7, this stop member 26 continues to bear against the end of cartridge 102 while cartridge 24 is being chambered. In FIG. 8 the lifters are translating back as barrel 66 is returning to chamber position. The next position of the lifters is that shown in FIG. 5 where the stop member 26 has moved from behind the magazine and the next cartridge in the magazine is free to move rearwardly to abut the breech block, and subsequently be translated to chamber position behind the barrel 66 as the barrel moves rearwardly.

FIGS. 10 and 11 show the solution to another problem. If for some reason a spent cartridge fails to be extracted and ejected, this cartridge will plug up the barrel and prevent its return over the next cartridge then in place against the breech block 100 behind the barrel. The positioning of the new cartridge against the breech block 100 further prevents the manual removal of the spent cartridge from the barrel. The solution to this problem is to sense when a spent cartridge remains in the barrel and, when this occurs, to disengage the feed levers from further actuation.

The views of FIGS. 10 and 11 are of the left hand side and are in elevation. The barrel 66 points to the left. FIG. 10 shows how spent cartridge 24 is normally ejected. As barrel 66 moves forwardly after cartridge 24 has been fired, it moves chamber 54 forwardly (after projection 74 engages edge 76 of slot 72). A cartridge ejector 104 is pivotally mounted by pin 106 on receiver 10 and rocks clockwise as the barrel 66 and chamber 54 move forward. Forward movement of chamber 54 exposes the cartridge casing 24 which remains against breech block 100 where it is held by retainer 108. The rear end 110 strikes cartridge 24 to eject it from the receiver. This is the intended function and operation, and there is no malfunction.

When there is no ejection malfunction and the barrel chamber 54 is empty, a sensing lever 112 causes the wedge shaped contact 86 on feed actuator 82 to engage feed lever 78 as the barrel moves rearwardly. This rotates the feed lifters 20, 22 to load the next cartridge as the barrel 66 returns to chamber position. This lever 112 is an extension of feed actuator 82, pivoting on pin 84. It has a projection 114 that drops down through a slot in chamber 54. If there is no cartridge in the chamber it drops down more than if a cartridge was there, as in FIG. 11.

As shown in FIG. 11, a cartridge 24 in chamber 54 causes the wedge shaped contact 86 to miss engagement with feed lever 78 upon return of the barrel to chamber. When this occurs, feed lifter 78 does not rotate and no new cartridge is fed into the chamber.

Dotted line 116 in FIGS. 10 and 11 establishes the position below which there is receiver structure, not shown. Above this line is the word "Empty" on the receiver. When the barrel returns to chamber position, the word "Empty" is still visible, unless there is a cartridge in chamber. On sensing lever 112 is the word "Loaded." When there is a cartridge in chamber, lever 112 is raised by the projection 114 contacting the cartridge, and the word "Loaded" on the lever covers the word "Empty." In this manner the user knows immediately whether it is necessary to load before firing or whether a cartridge is already chambered and ready for firing.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A cartridge soft feed mechamism comprising:
a feed actuator mounted for longitudinal movement along an axis parallel to that of a gun barrel,
a feed lever pivotally mounted on a gun,
a cartridge magazine mounted on said gun and having an open rear end from which cartridges exit upon being chambered, said rear end being at least a cartridge length forward of a receiver breech block to permit passage of a cartridge therebetween,
a pair of feed lifters pivotally mounted to extend one behind the other on said gun,
said feed lever being positioned forwardly of and pivotally connected to said feed lifters to pivot said lifters, thereby moving a cartridge that is positioned between said magazine and said breech block to its chamber position rearwardly of said barrel upon longitudinal movement of said feed actuator.

2. A cartridge soft feed mechanism as in claim 1 including means for retaining cartridges in said magazine during movement of said lifters.

3. A cartridge soft feed mechanism as in claim 2 wherein said means is a stop member on one of said lifters, said stop member engaging the rearwardmost cartridge in said magazine throughout movement of said lifters.

4. A cartridge soft feed mechanism as in claim 1 wherein said gun barrel moves along its longitudinal axis and said feed actuator moves longitudinally therewith, said feed actuator engaging and pivoting said feed lever when said gun barrel moves rearwardly.

5. A cartridge soft feed mechanism as in claim 1 wherein said magazine is laterally disposed from said barrel and said feed lifters move cartridges laterally from rearwardly of said magazine to rearwardly of said barrel.

6. A cartridge soft feed mechanism as in claim 1 wherein one of said lifters has a shorter length than the other, said lifter of shorter length being pivotal through a greater arc than the lifter of longer length, thereby maintaining the axis of said cartridge being moved thereby parallel to the axis of said gun barrel during movement thereof.

7. A cartridge soft feed mechanism as in claim 1 in combination with interruptor means to disengage said feed actuator from contact with said feed lever during longitudinal movement of said actuator.

8. A cartridge soft feed mechanism as in claim 1, said feed actuator being pivotally mounted on said gun barrel and adapted to move longitudinally therewith, said actuator terminating at its rearmost end in a downwardly protruding projection, a chamber on the end of said barrel to receive a cartridge, said projection extending into said chamber in the absence of a cartridge therein, said projection abutting a cartridge when said cartridge is in said chamber, said actuator terminating at its forward end in a contact engagable with said feed lever when said projection extends into said chamber, said contact missing engagement with said feed lever when said projection abuts a cartridge in said chamber.

* * * * *